United States Patent [19]

Peck

[11] 4,389,918

[45] Jun. 28, 1983

[54] AMMUNITION BELT FEED MAGAZINE SYSTEM

[75] Inventor: John H. Peck, Fountain Valley, Calif.

[73] Assignee: The United States of America as represented by the Secretary of the Army, Washington, D.C.

[21] Appl. No.: 267,126

[22] Filed: May 26, 1981

[51] Int. Cl.[3] ..... F41C 25/00

[52] U.S. Cl. ..... 89/34; 89/33 BC

[58] Field of Search ..... 89/34, 33 BC, 33 BB, 89/33 BA, 33 B, 33 CA; 42/50; 206/3

[56] References Cited

U.S. PATENT DOCUMENTS

| | | | |
|---|---|---|---|
| 2,401,762 | 6/1946 | Irasek | 89/34 |
| 2,936,677 | 5/1960 | Vickers | 89/33 BC |
| 3,974,739 | 8/1976 | Bourlet | 206/3 |

FOREIGN PATENT DOCUMENTS

| | | | |
|---|---|---|---|
| 2051356 | 4/1972 | Fed. Rep. of Germany | 89/34 |
| 815469 | 7/1937 | France | 89/34 |
| 1126545 | 9/1968 | United Kingdom | 206/3 |

*Primary Examiner*—Stephen C. Bentley
*Assistant Examiner*—Maureen Ryan
*Attorney, Agent, or Firm*—Robert P. Gibson; Anthony T. Lane; A. Victor Erkkila

[57] ABSTRACT

A belt-fed automatic weapon includes a retainer for holding one or more of the leading rounds on the belt exposed external to the magazine in a position where they can be picked up and automatically fed into the automatic weapon by a feed sprocket in the automatic weapon during insertion of the magazine into the weapon. This permits one-hand loading by an erect walking operator whose second hand is occupied supporting the weapon. A belt guide at the exit of the magazine prevents jamming of linked rounds when the weapon is fired upside down or on its sides.

1 Claim, 4 Drawing Figures

AMMUNITION BELT FEED MAGAZINE SYSTEM

GOVERNMENTAL INTEREST

The invention described herein may be manufactured, used and licensed by or for the Government for governmental purposes without the payment to me of any royalties thereon.

BACKGROUND OF THE INVENTION

The capacity of a magazine on an automatic weapon places a constraint on the number of rounds which may be fired between reloading operations. Magazines for hand-carried weapons have generally been limited by the weight of the magazine and its contained rounds to spring-loaded magazines having a capacity of a few dozen rounds.

Although belt-fed or linked rounds provide the potential for a large magazine capacity, the weight of conventional ammunition and their containers has limited belt and linked ammunition feed to stationary or mobile applications.

The recent trend to smaller and lighter ammunition such as, for example, 5.56 mm cartridges, permits a single operator to carry enough ammunition mounted on the weapon to make belt-type feed very attractive if it could be readily loaded by any upright walking operator carrying the weapon. Since one of the operator's hands is occupied supporting the weapon, any reloading operation must be accomplished by his single remaining hand. Furthermore, besides mounting the ammunition, it should be made ready to firing preferably by the mere act of mounting the ammunition on the weapon.

OBJECTS AND SUMMARY OF THE INVENTION

Accordingly, it is an object of the invention to provide an ammunition belt feed magazine system which overcomes the drawbacks of the prior art.

It is a further object of the invention to provide an ammunition belt feed magazine system which can be inserted in an automatic weapon and made ready to fire with one hand in a matter of seconds by an operator standing upright even while walking.

According to an aspect of the present invention, there is provided a feed magazine for feeding linked rounds into a feed mechanism of an automatic weapon, comprising a container having at least two generally parallel sides, two ends, a top and a bottom, the sides having means for sliding engagement under the weapon for mounting the container in a generally linear travel, a delivery slot in the top for delivery of the linked rounds to the automatic weapon, and means for retaining at least one leading round in a position external to the container from which position the leading round can be engaged by the feed mechanism and fed to the automatic weapon upon completion of the mounting.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
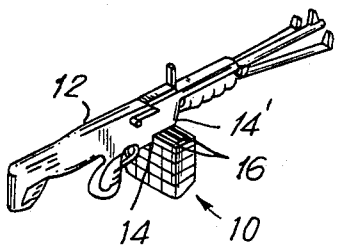
FIG. 1 is a perspective view of an automatic weapon having mounted thereon an ammunition belt feed magazine system according to an embodiment of the present invention.

Referring now to FIG. 1, there is shown, generally at 10, an ammunition belt feed magazine system operatively installed in an automatic weapon 12. As will be more fully developed hereinafter, ammunition belt feed magazine system 10 is inserted into automatic weapon 12, by sliding it from left to right beneath automatic weapon 12 in magazine slots 14 and 14' which grip magazine 10 in a tongue-in-groove fit. The act of inserting magazine 10 into automatic weapon 12 performs a complete charging cycle and places the weapon in condition to fire. Such charging cycle can be performed with one hand by a single person walking erect while the other hand is engaged in holding automatic weapon 12.

Figure 2:
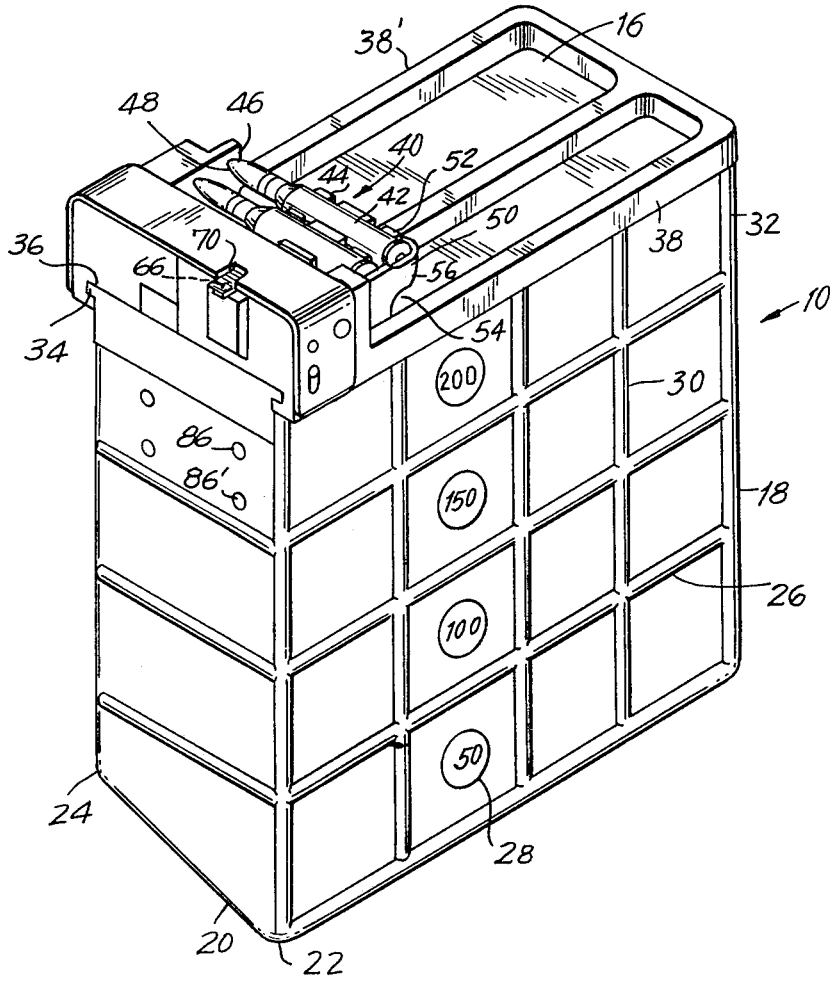
FIG. 2 is an enlarged perspective view of an ammunition belt feed magazine system according to an embodiment of the present invention.

Referring now to FIG. 2, there is shown a closeup view of magazine system 10. A box-like container portion 18, which may be of any convenient material but is preferably of molded plastic and most preferably of polypropylene plastic containing about 30% glass-fill, has a generally rectangular horizontal cross section and has a tapered bottom in vertical cross section. That is, a bottom 20 of container portion 18 is tapered, or ramp shaped, from one edge 22 to a second edge 24. As is well known to those skilled in the art, some rounds of ammunition are of non-uniform cross section from end to end. The greater depth of container portion 18 adjacent edge 22 accommodates the greater diameter of rounds near their aft end as compared to their forward end and thus permits a top layer of a belt placed within container portion 18 to lie flat and generally parallel to cover 16.

A plurality of generally horizontal capacity-indicating ridges 26 may be integrally formed in container portion 18 during the molding thereof. In addition, capacity indicia 28 may be integrally molded in container portion 18 in association with capacity-indicating ridges 26. Thus, a user of feed magazine 10 may be able to estimate the number of rounds remaining in container portion 18 by either sighting through the plastic material or by flexing the plastic material to determine the height of stacked rounds therein.

Vertical reinforcing ridges 30 and reinforced corners 32 may be integrally formed during the molding of container portion 18.

A tongue 34 integrally formed along each top lateral edge of container portion 18 is engaged by a groove 36 integrally formed in cover 16. A conventional latching mechanism (not shown) prevents cover 16 from being slid off container portion 18 until desired. Outward directed ridges 38 and 38' are provided for sliding into magazine slots 14 and 14', respectively, (FIG. 1).

A leading-rounds retainer, shown generally at 40, holds the leading one, two or more rounds 42 in position for feeding into the feed mechanism (not shown) of an automatic weapon. In the embodiment shown, two leading rounds 42 are held disposed generally parallel to the surface of cover 16 and are held in place by clips 44 which may be of metal, but are more preferably of plastic and most preferably are integrally molded of plastic with cover 16. A vertical portion 46 of leading-rounds retainer 40 protects the nose 48 of the leading rounds and a second vertical portion 50 secures the butt ends 52 of rounds 42 against lateral motion. An undercut 54 is provided for engagement with a mating portion in automatic weapon 12 and an angled entry portion 56 helps guide the completion of insertion of feed magazine 10 into automatic weapon 12.

Figure 3:
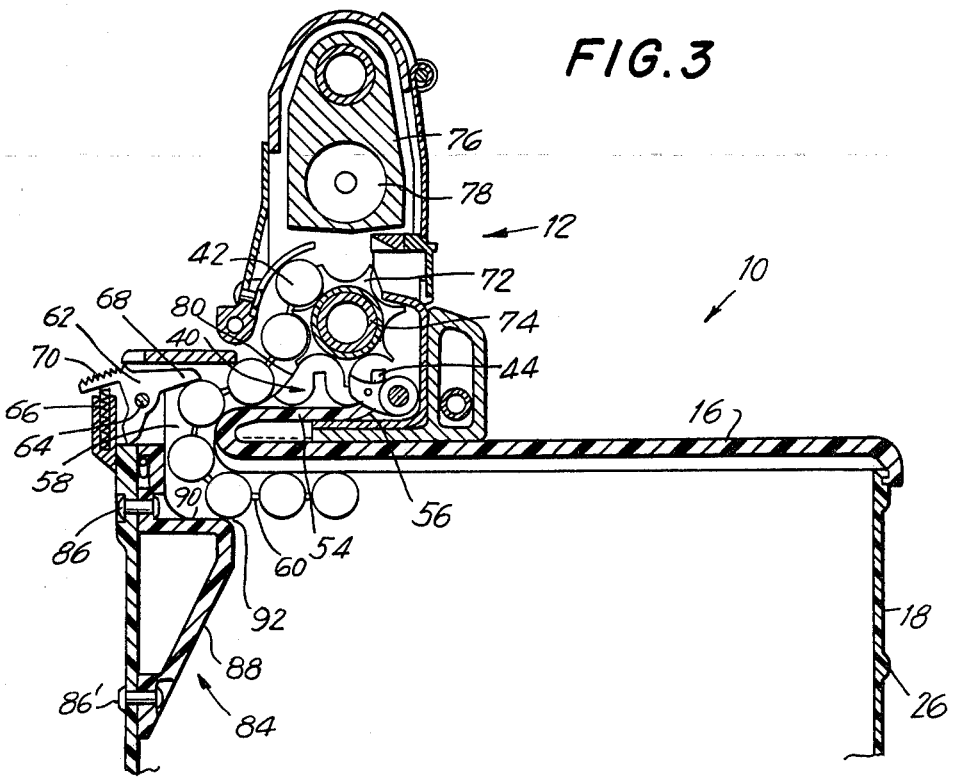
FIG. 3 is a transverse cross section of the automatic weapon and a portion of the feed magazine of FIG. 1.

Referring now to FIG. 3, a delivery slot 58 in cover 16 permits the feeding of rounds 42 linked together by links 60 to automatic weapon 12.

A pawl 62, which is urged in the clockwise direction about a pivot 64 by a helical return spring 66 includes a finger 68 which engages rounds 42 and prevents their falling back into feed magazine 10. A thumb lever 70 permits rotating pawl 62 in the counterclockwise direction in FIG. 3 against the urging of return spring 66 and thus permits the manual return of rounds 42 into container portion 18.

A conventional feed sprocket 72 on a tubular shaft 74 elevates rounds 42 toward a bolt carrier 76. A conventional automatic loading and extraction apparatus (not shown) is provided in automatic weapon 12 for serving a chamber 78. A stripper block 80 lifts leading rounds 42 from leading rounds retainer 40 and guides them into the embrace of feed sprocket 72.

As feed magazine 10 is slid into place from left to right in FIG. 3, stripper block 80 lifts the first leading round 42 into the embrace of feed sprocket 72 and, as feed magazine 10 is inserted further to the right, lifts second leading round 42 from leading rounds retainer 40. This urges feed sprocket 72 in the clockwise direction in FIG. 3 until, when feed magazine 10 is fully seated in automatic weapon 12, leading rounds 42 are fully engaged by feed sprocket 72 without any other act being required by the weapon operator.

Figure 4:
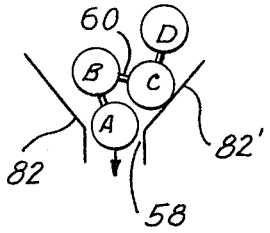
FIG. 4 is a simplified schematic view showing the manner in which linked rounds can become jammed in the exit of a magazine.

Experience with belted ammunition in portable automatic weapons discloses that the rapid undulation of the belt as it feeds can cause the rounds to jam at the entry to delivery slot 58, particularly when the weapon is fired upside down or on either side. The problem arises as in the hypothetical case shown in FIG. 4 wherein delivery slot 58 is fed by funnel-shaped walls 82 and 82'. If the weapon is turned such that gravity acts downward toward delivery slot 58, it is possible for the third round 42C to move into a blocking position wherein it can prevent the second leading round 42B from following the first leading round 42A through delivery slot 58. Such bunching up, of course, causes feed stoppages and weapon misfire.

Returning now to FIG. 3, the geometry of the exit from container portion 18 to delivery slot 58 is modified by a belt guide 84 affixed to container portion 18 adjacent delivery slot 58 by any convenient means such as, for example, by rivets 86 and 86'. Belt guide 84 includes an angled wall 88 which makes an angle greater than 90° with the undersurface of cover 16. Belt guide 84 also includes a horizontal portion 90 which is parallel to the undersurface of cover 16 and forms a part of an entry slot 92 for guiding linked rounds 42 into delivery slot 58 with much lower probability of bunching up and jamming.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A feed magazine for feeding linked rounds into a feed mechanism of an automatic weapon, comprising:

a container having at least two generally parallel sides, two ends, a top and a bottom;

said sides having means for sliding engagement under said weapon for mounting said container in a generally linear travel;

a delivery slot in said top for delivery of said linked rounds to said automatic weapon; and means for retaining at least one leading round in a position external to said container from which position said leading round can be engaged by said feed mechanism and fed to said automatic weapon upon completion of said mounting; wherein said bottom is sloped from one of said sides to the other thereof whereby, when said container is substantially full of linked rounds, a top layer of said rounds is permitted to lie substantially parallel to said top.

* * * * *